US008492061B2

(12) United States Patent
Jeong et al.

(10) Patent No.: US 8,492,061 B2
(45) Date of Patent: Jul. 23, 2013

(54) ELECTROPHOTOGRAPHIC TONER AND METHOD OF PREPARING THE SAME

(75) Inventors: Jae-Hyeuk Jeong, Suwon-Si (KR); Kyeong Pang, Suwon-Si (KR); Jung-Ik Choi, Suwon-Si (KR); Soon-Cheol Jeong, Seoul (KR); Hong-Chul Shin, Suwon-Si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 611 days.

(21) Appl. No.: 12/612,406

(22) Filed: Nov. 4, 2009

(65) Prior Publication Data

US 2010/0167194 A1 Jul. 1, 2010

(30) Foreign Application Priority Data

Dec. 26, 2008 (KR) ..... 10-2008-0134949

(51) Int. Cl.
*G03G 9/087* (2006.01)
*G03G 9/093* (2006.01)

(52) U.S. Cl.
USPC ..... 430/108.4; 430/108.7; 430/108.8; 430/110.3; 430/137.14

(58) Field of Classification Search
USPC ..... 430/108.4, 108.7, 108.8, 123.52, 430/123.53, 110.3, 137.14
See application file for complete search history.

(56) References Cited

U.S. PATENT DOCUMENTS

| | | | | |
|---|---|---|---|---|
| 5,578,408 | A * | 11/1996 | Kohtaki et al. | 430/108.2 |
| 6,235,441 | B1 * | 5/2001 | Tanikawa et al. | 430/108.21 |
| 6,333,131 | B1 * | 12/2001 | Ishiyama et al. | 430/108.6 |
| 6,444,389 | B1 * | 9/2002 | Ninomiya et al. | 430/110.3 |
| 7,172,844 | B2 * | 2/2007 | Umemura et al. | 430/108.4 |
| 2003/0165759 | A1 * | 9/2003 | Suzuki et al. | 430/108.4 |
| 2008/0182195 | A1 * | 7/2008 | Jeong et al. | 430/111.4 |

* cited by examiner

*Primary Examiner* — Jonathan Jelsma
(74) *Attorney, Agent, or Firm* — Stanzione & Kim, LLP

(57) ABSTRACT

The disclosure provides electrophotographic toner and a method of preparing the same. The toner includes a latex, a colorant, and a releasing agent, wherein the toner has a weight-average molecular weight of about 50,000 to about 80,000; a complex viscosity of about $1\times10^3$ to about $5\times10^4$ (Pa·s) at a temperature ranging from about 100° C. to about 140° C.; and a storage modulus Pa (dG') to a loss modulus Pa (dG") (dG'/dG") ratio of about 1.10 to about 1.25.

14 Claims, 2 Drawing Sheets

ELECTROPHOTOGRAPHIC TONER AND METHOD OF PREPARING THE SAME

CROSS-REFERENCE TO RELATED PATENT APPLICATION

This application claims the benefit of Korean Patent Application No. 10-2008-0134949, filed on Dec. 26, 2008 in the Korean Intellectual Property Office, the disclosure of which is hereby incorporated by reference in its entirety for all purposes.

TECHNICAL FIELD

The present disclosure generally relates to electrophotographic toner and a method of preparing the same.

BACKGROUND OF RELATED ART

For electrophotographic processes or electrostatic recording process, developers that visualize electrostatic images or electrostatic latent images may be classified into two-component developers and one-component developers. Two-component developers are composed of toner and carrier particles; whereas one-component developers are substantially composed of only toner. That is, one-component developers do not use carrier particles. One-component developers may be further classified into magnetic developers and nonmagnetic developers, in which magnetic developers contain a magnetic component while nonmagnetic developers do not. In addition, fluiding agents may be added to nonmagnetic one-component developers in order to improve the fluidity of the toner. Examples of fluiding agents include, but are not limited to, colloidal silica and the like.

In general, toners contain colored particles, which may be obtained by dispersing a pigment such as carbon black or other additives in latex. These toners may be prepared using either a pulverizing method or a polymerizing method. In the pulverizing method, a synthesized resin, a pigment, and optionally other additives, are melted, pulverized, and sorted to obtain particles having desirable diameters for use in the toner. In the polymerizing method, a pigment, a polymerization initiator, and optionally other additives such as cross-linking agents or antistatic agents, are uniformly dissolved in or dispersed into a polymerization monomer solution to provide a polymerization monomer composition. The composition may be dispersed into an aqueous dispersion medium containing a dispersion stabilizer, and the mixture may be stirred to provide microdroplet particles of the polymerization monomer composition. Subsequently, the temperature of the composition may be increased to provide a suspension of colored polymerization particles having the desired diameters for the polymerization toner.

Common image forming apparatuses include electrophotographic apparatuses and electrostatic recording apparatuses. In these apparatuses, an image may be formed by first exposing an image on a uniformly charged photoreceptor to form an electrostatic latent image. The toner may be attached to the electrostatic latent image through use of a transfer medium such as transfer paper or the like. The toner image may then be fused on the transfer medium using any of a variety of different methods including but not limited to heating, pressurizing, or applying a solvent vapor. In most fusing processes, the transfer medium with the toner image passes through fusing and pressing rollers, wherein the toner may be heated and pressed to fuse the toner image to the transfer medium.

Images formed by an image forming apparatus such as an electrophotocopier, should satisfy the requirements of high precision and accuracy. Toner used in an image forming apparatus may be obtained using a pulverizing method. According to this method, colored particles having a large range of sizes may be easily formed. To obtain satisfactory developing properties, the colored particles are sorted according to their size to reduce particle size distribution. However, it may be difficult to precisely control particle size and particle size distribution using conventional mixing/pulverizing processes. In addition, when preparing fine-particle toner, the toner preparation yield may be adversely affected by the sorting process. Also, there may be limits to the change/adjustment of toner design for obtaining the desirable charging and fusing properties. Accordingly, there is a need for a polymerized toner, the size of particles of which is easy to control and that does not require a complex manufacturing process such as sorting.

SUMMARY OF THE DISCLOSURE

According to an aspect of the present disclosure, the disclosure provides an electrophotographic toner including a latex, a colorant, and a releasing agent, wherein the electrophotographic toner has a weight-average molecular weight of about 50,000 to about 80,000; a complex viscosity of about $1\times10^3$ to about $5\times10^4$ (Pa·s) at a temperature ranging from about 100° C. to about 140° C.; and a storage modulus Pa (dG') to a loss modulus Pa (dG") (dG'/dG") ratio of about 1.10 to about 1.25.

According to another aspect of the present disclosure, the electrophotographic toner provided herein may further include silicon (Si) and iron (Fe), each independently present in a range of about 3 ppm to about 1,000 ppm.

According to another aspect of the present disclosure, the releasing agent present in the electrographic toner provided herein, may include a mixture of a paraffin-based wax and an ester-based wax; or an ester group containing paraffin-based wax. The content of the ester group contained within the releasing agent may be from about 2% by weight to about 10% by weight based on the total weight of the releasing agent.

According to another aspect of the present disclosure, in the electrophotographic toner provided herein, the volume average particle diameter of the toner may be from about 3 μm to about 8 μm.

According to another aspect of the present disclosure, in the electrophotographic toner provided herein, the average value of circularity of the toner may be from about 0.940 to about 0.980.

According to another aspect of the present disclosure, in the electrophotographic toner provided herein, the values of the volume average particle size distribution index (GSDv) and the number average particle size distribution index (GSDp) of the toner may be less than about 1.25, respectively.

According to another aspect of the present disclosure, the disclosure provides a method of preparing an electrophotographic toner, the method comprising the steps of a) mixing a primary latex particle, a colorant dispersion, and a releasing agent dispersion to provide a mixture; b) adding an agglomerating agent to the mixture to prepare a primary agglomerated toner; and c) coating a secondary latex, prepared by polymerizing one or more polymerizable monomers, on the primary agglomerated toner, to prepare a secondary agglomerated toner, thus preparing the electrographic toner, wherein the electrophotographic toner has a weight-average molecular weight of about 50,000 to about 80,000; a complex viscosity of about $1\times10^3$ to about $5\times10^4$ (Pa·s) at a temperature ranging from about 100° C. to about 140° C.; and a storage modulus Pa (dG') to a loss modulus Pa (dG") (dG'/dG") ratio of about 1.10 to about 1.25.

According to another aspect of the present disclosure, the disclosure provides a method of preparing an electrophotographic toner, wherein the primary latex particle may include polyester alone; a polymer obtained by polymerizing one or more polymerizable monomers; or a mixture thereof.

According to another aspect of the present disclosure, the disclosure provides a method of preparing an electrophotographic toner, further including d) coating a tertiary latex, prepared by polymerizing one or more polymerizable monomers, on the secondary agglomerated toner, thus preparing the electrographic toner.

According to another aspect of the present disclosure, the disclosure provides a method of preparing an electrophotographic toner, wherein the polymerizable monomer may include at least one monomer selected from styrene-based monomers; acrylic acid or methacrylic acid; derivatives of (metha)acrylates; ethylenically unsaturated mono-olefins; halogenized vinyls; vinyl esters; vinyl ethers; vinyl ketones; and nitrogen containing vinyl compounds.

According to another aspect of the present disclosure, the disclosure provides a method of preparing an electrophotographic toner, wherein the releasing agent dispersion may include a mixture of a paraffin-based wax and an ester-based wax; or an ester group containing paraffin-based wax.

According to another aspect of the present disclosure, the disclosure provides a method of preparing an electrophotographic toner, wherein the agglomerating agent may include Si and Fe containing metallic salts.

According to another aspect of the present disclosure, the disclosure provides a method of preparing an electrophotographic toner, wherein the agglomerating agent may include polysilica iron.

According to another aspect of the present disclosure, the disclosure provides an imaging method, the method comprising the steps of: a) attaching an electrophotographic toner to a surface of a photoreceptor on which an electrostatic latent image may be formed so as to form a visible image; and b) transferring the visible image onto a transfer medium, wherein the toner includes an electrophotographic toner having a weight-average molecular weight of about 50,000 to about 80,000; a complex viscosity of about $1\times10^3$ to about $5\times10^4$ (Pa·s) at a temperature ranging from about 100° C. to about 140° C.; and a storage modulus Pa (dG') to a loss modulus Pa (dG") (dG'/dG") ratio of about 1.10 to about 1.25.

According to another aspect of the present disclosure, the disclosure provides a toner supplying unit comprising: a toner tank for storing toner; a supplying part projecting inside the toner tank to discharge the toner from the toner tank; and a toner agitating member rotatably disposed inside the toner tank to agitate the toner in the toner tank including a location on a top surface of the supplying part, wherein the toner includes an electrophotographic toner having a weight-average molecular weight of about 50,000 to about 80,000; a complex viscosity of about $1\times10^3$ to about $5\times10^4$ (Pa·s) at a temperature ranging from about 100° C. to about 140° C.; and a storage modulus Pa (dG') to a loss modulus Pa (dG") (dG'/dG") ratio of about 1.10 to about 1.25.

According to another aspect of the present disclosure, the disclosure provides an imaging apparatus including: an image carrier; an image forming unit that forms an electrostatic latent image on a surface of the image carrier; a unit receiving a toner, a toner supplying unit that supplies the toner onto the surface of the image carrier to develop the electrostatic latent image on the surface of the image carrier into a toner image; and a toner transferring unit that transfers the toner image to a transfer medium from the surface of the image carrier, wherein the toner includes an electrophotographic toner having a weight-average molecular weight of about 50,000 to about 80,000; a complex viscosity of about $1\times10^3$ to about $5\times10^4$ (Pa·s) at a temperature ranging from about 100° C. to about 140° C.; and a storage modulus Pa (dG') to a loss modulus Pa (dG") (dG'/dG") ratio of about 1.10 to about 1.25.

The present disclosure provides toner and methods related thereto, which provide a superior quality image with high gloss and having a wide fusing region.

BRIEF DESCRIPTION OF THE DRAWINGS

The above and other features and advantages of the present disclosure will become more apparent with reference to the attached drawings in which.

DETAILED DESCRIPTION OF THE DISCLOSURE

Figure 1:
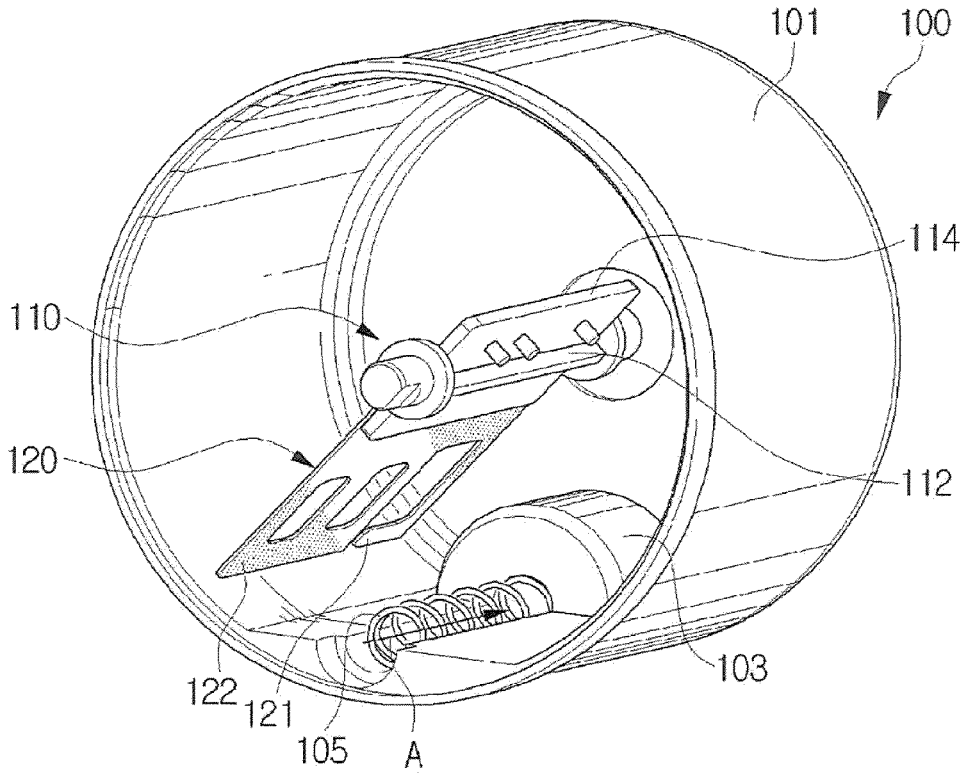
FIG. 1 is a view of a toner supplying apparatus according to an embodiment of the present disclosure.

The present disclosure will now be described more fully with reference to the accompanying drawings, in which the embodiments of the present disclosure are shown.

The present disclosure provides an electrophotographic toner that includes a latex, a colorant, and a releasing agent. The electrophotographic toner has a weight-average molecular weight of about 50,000 to about 80,000; a complex viscosity of about $1\times10^3$ to about $5\times10^4$ (Pa·s) at a temperature ranging from about 100° C. to about 140° C.; and a dG'/dG" ratio of about 1.10 to about 1.25.

In the electrophotographic toner provided herein, the value of the dG'/dG" ratio is the inclination of a storage modulus Pa (dG') to a loss modulus Pa (dG") in a frequency region of about 0.1 rad/s to about 100 rad/s. The value of the dG'/dG" ratio of the toner may be achieved by scanning a specific temperature frequency using a rheometer having two circular disks, for example, TA ARES.

The frequency region in which the value of the dG'/dG" ratio is measured denotes a section available to ensure the reliability of the measurement. If the value of the dG'/dG" ratio is less than about 0.1 rad/s, a sample may be below the level of a proper sensitivity region of equipment, or data reliability may be reduced. If the value of the dG'/dG" ratio is greater than about 100 rad/s, two samples may be separated from the two circular disks, and thus, it may be difficult to obtain reliable data.

The dG'/dG" ratio is a parameter that does not have a dependence with respect to a molecular weight and a temperature after toner melting (after being heated to about 100° C.). In case of a single component, the dG'/dG" ratio may be changed according to the molecular weight distribution and chain conformation. The dG'/dG" ratio depends greatly on the molecular weight distribution and conformational property of the latex even if there may be a slight deviation of a change according to a dispersion state or a property of an additive.

In case of a linear single material, the dG'/dG" ratio has a value less than about 2 rad/s. As the branch or a chain conformation may be changed, and thus may be deviated from a linear structure, the value of the dG'/dG" ratio may be reduced. Thus, the conformational property of the latex may be quantified through the dG'/dG" ratio, and the fusing temperature range and glossiness of the toner may be estimated. Even if the change of the value according to the conformational property may be small, it may indirectly grasp a performance releasable from an additive, specifically a wax, in a common state and at a high-temperature.

The value of the dG'/dG" ratio may be reduced when the molecular weight distribution is wide or the dispersion state is inferior. When the molecular weight distribution is wide, the viscosity behavior may be slowly reduced according to the temperature during fusing. Thus, the molecular weight distribution may have a wide fusing region, but the glossiness may be relatively reduced. When the toner is prepared using latex having a smooth molecular weight distribution, the value of the dG'/dG" ratio may be slightly reduced due to dispersion defection. In this case, charge/storability defection may occur due to the dispersion defection of a surface wax or other additives.

In case where the molecular weight distribution of the latex may be determined using the dG'/dG" ratio, a gel contained in the sample or test errors in the pretreatment process may be removed through a mechanical measurement, as compared to a measurement using a gel permeation chromatogram (GPC). In addition, since the test may be performed in a state similar to a fusing state, the actual condition may be accurately estimated.

The dG'/dG" ratio may be from about 1.10 to about 1.25. For example, the dG'/dG" ratio may be from about 1.10 to about 1.20, or about 1.15 to about 1.20. If the dG'/dG" ratio is less than about 1.10, it may be difficult to obtain uniform images, and glossiness may be reduced. An additive may be defectively dispersed to decrease storability because fusing behavior may be sensitive to temperature. Alternatively, if the dG'/dG" ratio is greater than about 1.25, the fusing region may be narrow, or the manufacturing yield and productivity may be reduced.

The toner may have a weight-average molecular weight of about 50,000 to about 80,000. For example, the toner may have a weight-average molecular weight of about 60,000 to about 80,000, or about 70,000 to about 80,000. If the weight-average molecular weight is less than about 50,000, durability may be reduced. Alternatively, if the weight-average molecular weight is greater than about 80,000, the fusing range may be widened to decrease the durability of equipment.

A complex viscosity of the toner may be from about $1\times10^3$ to about $5\times10^4$ (Pa·s) at a temperature ranging from about 100° C. to about 140° C. For example, the complex viscosity of the toner may be from about $1.5\times10^3$ to about $4.5\times10^4$ (Pa·s) at the temperature ranging from about 100° C. to about 140° C. If the complex viscosity is less than about $1\times10^3$ (Pa·s), offset, wrap jam, or glossiness may be reduced. Alternatively, if the complex viscosity is greater than about $5\times10^4$ (Pa·s), it may be difficult to obtain a proper fusing strength and glossiness at a temperature of less than 160° C.

According to an embodiment of the present disclosure, a method of preparing the electrophotographic toner includes the following processes: mixing primary latex particles, a colorant dispersion, and a releasing agent dispersion to prepare a mixture thereof; adding an agglomerating agent to the mixture to prepare a primary agglomerated toner; and coating a secondary latex, prepared by polymerizing one or more polymerizable monomers, on the primary agglomerated toner to prepare a secondary agglomerated toner, thus preparing the electrographic toner, wherein the electrophotographic toner has a weight-average molecular weight of about 50,000 to about 80,000; a complex viscosity of about $1\times10^3$ to about $5\times10^4$ (Pa·s) at a temperature ranging from about 100° C. to about 140° C.; and dG'/dG" of about 1.10 to about 1.25.

Examples of the agglomerating agent may include NaCl, $MgCl_2$, $MgCl_2$, $[Al_2(OH)_nCl_{6-n}]_m$ ($Al_2(SO_4)_3$ $18H_2O$), poly aluminum chloride (PAC), poly aluminum sulfate (PAS), poly aluminum sulfate silicate (PASS), ferrous sulfate, ferric sulfate, ferric chloride, slaked lime, $CaCO_3$, and Si and Fe containing metallic salts, but are not limited thereto.

The content of the agglomerating agent based on 100 parts by weight of the primary latex particle may be from about 3 parts by weight to about 16 parts by weight. For example, the content of the agglomerating agent may be from about 5 parts by weight to about 12 parts by weight. If the content of the agglomerating agent is less than about 3 parts by weight, agglomeration efficiency may be reduced; and if the content of the agglomerating agent is greater than 16 parts by weight, chargeability of the electrophotographic toner may be reduced.

According to an embodiment of the present disclosure, the electrophotographic toner uses a Si and Fe containing metallic salt as the agglomerating agent in the toner preparation process. The Si and Fe contents contained in the resultant toner may each independently be from about 3 ppm to about 1,000 ppm. For example, the Si and Fe contents may each independently be present in about 300 ppm to about 800 ppm. If the Si and Fe contents are less than about 3 ppm, respectively, the desired effects may not be obtained. Alternatively, if the Si and Fe contents are greater than about 1,000 ppm, respectively, limitations such as charge reduction may occur and thus, the proper developing performance may be lost.

The Si and Fe containing metallic salt may also include, for example, polysilica iron. The Si and Fe containing metallic salt may be added to increase ionic strength and collisions between particles during the disclosed toner preparation method, which may increase the size of the primary agglomerated toner. An example of the metallic salt is polysilica iron, including but not limited to Model Nos. PSI-025, PSI-050, PSI-085, PSI-100, PSI-200, and PSI-300 (products of Suido Kiko Kaisha), sold and available in the market. The properties and compositions of PSI-025, PSI-050, and PSI-085 are listed in Table 1.

TABLE 1

| Kinds | | PSI-025 | PSI-050 | PSI-085 | PSI-100 | PSI-200 | PSI-300 |
|---|---|---|---|---|---|---|---|
| Silicate/Fe mole ratio (Si/Fe) | | 0.25 | 0.5 | 0.85 | 1 | 2 | 3 |
| Main component concentration | Fe(wt %) | 5.0 | 3.5 | 2.5 | 2.0 | 1.0 | 0.7 |
| | $SiO_2$(wt %) | 1.4 | 1.9 | 2.0 | | 2.2 | |
| pH (1 w/v %) | | 2-3 | | | | | |
| Specific gravity (20° C.) | | 1.14 | 1.13 | 1.09 | 1.08 | 1.06 | 1.04 |
| Viscosity (mPa · S) | | 2.0 or higher | | | | | |
| Average molecular weight | | 500,000 | | | | | |
| Appearance | | Yellowish brown transparent liquid | | | | | |

Since the Si and Fe containing metallic salt may be used as the agglomerating agent in the electrophotographic toner preparation method, quench hardening may be possible, and the particle shape may be controllable.

According to an embodiment of the present disclosure, the volume average particle diameter of the electrophotographic toner may be from about 3 μm to about 8 μm. For example, the volume average particle diameter of the electrophotographic toner may be from about 5 μm to about 7 μm. The average value of circularity may be from about 0.940 to about 0.980. For example, the average value of circularity may be from about 0.95 to about 0.975.

In general, although it may be more advantageous to obtain a high-resolution and a high-quality image as the toner particle decreases in size, it may be disadvantageous in terms of transfer speed and cleanability. Thus, it may be important to adequately control the volume average particle diameter. The volume average particle diameter may be measured using light scattering techniques.

If the volume average particle diameter of the electrophotographic toner is less than 3 μm, limitations in cleaning the photoreceptor and a reduction in yield may occur. In addition, a bodily injury may be inflicted on a person due to the scattering of toner. Alternatively, if the volume average particle diameter of the electrophotographic toner is greater than 8 μm, it may be difficult to obtain high-resolution and high-quality images. Furthermore, charging may not be uniformly performed, and the fusing properties of the toner may be decreased. Finally, a Doctor Blade may not be able to regulate the toner layer.

If the average value of circularity of the electrophotographic toner is less than about 0.94, the image developed on a transfer medium may have a high height, toner consumption may increase, and it may be difficult to obtain a sufficient coating rate of the image developed on the transfer medium due to a wide gap between the electrophotographic toner particles. Thus, to obtain the desired image concentration, a large amount of toner may be needed to increase the toner consumption. Alternatively, if the average value of the circularity of the electrophotographic toner is greater than about 0.980, the toner may be excessively supplied onto the developing sleeve. As a result, the electrophotographic toner may be uniformly coated on the developing sleeve together therewith to cause contamination.

The circularity of the electrophotographic toner may be measured using Image J software 1.33u (National Institutes of Health, USA). This software may be used for the quantification of image data after 50 scanning electron microscopy (SEM) pictures are selected from SEM pictures of the electrophotographic toner and calculated according to the following equation:

$$\text{Circularity}=4\pi\times(\text{area}/\text{circumference}^2).$$

The value of the circularity may be from 0 to 1, where a value of 1 corresponding to a perfect circle.

The volume average particle size distribution index (GSDv) or the number average particle size distribution index (GSDp) described herein, may be used as an index of the toner particle distribution. The GSDv and GSDp may be calculated as follows. First, the particle size distribution of the electrophotographic toner may be measured using a measuring device such as a Coulter Multisizer II (manufactured by Beckman Coulter Inc.). This may be drawn as an accumulated distribution from a small diameter size. For a divided particle size range (channel), this may be drawn taking into account the volume and the number of individual toner particles. Next, a cumulative particle diameter of 16% may be defined as a volume average particle diameter D16v and a number average particle diameter D16p. A cumulative particle diameter of 50% may be defined as a volume average particle diameter D50v and a number average particle diameter D50p. Similarly, a cumulative particle diameter of 84% may be defined as a volume average particle diameter D84v and a number average particle diameter D84p. Here, the GSDv may be defined as D84v/D16v, and the GSDp may be defined as D84p/D16p. The GSDv and GSDp may be calculated using their relational equations. The values of the GSDv and GSDp may each independently be less than about 1.25. For example, the values of the GSDv and GSDp may each independently be from about 1.20 to about 1.25. If the values of the GSDv and GSDp are each independently greater than 1.25, the particle diameters may not be uniform.

In the above-described electrophotographic toner preparation methods, the primary latex particles may include polyester alone; a polymer obtained by polymerizing one or more polymerizable monomers; or a mixture thereof (a hybrid type). When the polymer is used as the primary latex particles, the polymerizable monomers may be polymerized with a releasing agent such as a wax, or a releasing agent may be separately added to the polymer.

A primary latex particle having a particle size of less than about 1 μm, for example, from about 100 nm to about 300 nm, may be prepared by emulsion polymerization.

Here, the polymerizable monomer may be at least one monomer selected from styrene-based monomers such as styrene, vinyl toluene and a-methyl styrene; acrylic acid or methacrylic acid; derivatives of (metha)acrylates such as methyl acrylate, ethyl acrylate, propyl acrylate, butyl acrylate, 2-ethylhexyl acrylate, dimethylamino ethyl acrylate, methyl methacrylate, ethyl methacrylate, propyl methacrylate, butyl methacrylate, 2-ethylhexyl methacrylate, dimethylaminoethyl methacrylate, acrylonitrile, methacrylonitrile, acrylamide and metacrylamide; ethylenically unsaturated mono-olefins such as ethylene, propylene and butylenes; halogenized vinyls such as vinyl chloride, vinylidene chloride and vinyl fluoride; vinyl esters such as vinyl acetate and vinyl propionate; vinyl ethers such as vinyl methyl ether and vinyl ethyl ether; vinyl ketones such as vinyl methyl ketone and methyl isoprophenyl ketone; and nitrogen containing vinyl compounds such as 2-vinyl pyridine, 4-vinyl pyridine and N-vinyl pyrrolidone.

A polymerization initiator and a chain transfer agent may be used in the process of preparing the primary latex particle for the efficiency of the polymerization. Examples of the polymerization initiator are persulfate salts such as potassium persulfate and ammonium persulfate; azo compounds such as 4,4-azobis(4-cyano valeric acid), dimethyl-2,2'-azobis(2-methyl propionate), 2,2-azobis(2-amidinopropane)dihydrochloride, 2,2-azobi -2-methyl-N-1,1-bis(hydroxymethyl)-2-hydroxyethylpropioamide, 2,2'-azobis(2,4-dimethyl valeronitrile), 2,2'-azobis isobutyronitrile and 1,1'-azobis(1-cyclohexanecarbonitrile); and peroxides such as methyl ethyl peroxide, di-t-butylperoxide, acetyl peroxide, dicumyl peroxide, lauroyl peroxide, benzoyl peroxide, t-butylperoxy-2-ethyl hexanoate, di-isopropyl peroxydicarbonate and di-t-butylperoxy isophthalate. Also, an oxidization-reduction initiator in which the polymerization initiator and a reduction agent are combined may be used.

A chain transfer agent is a material used to convert a type of chain carrier in a chain reaction. A new chain has much less activity than that of a previous chain. The degree of polymerization of the monomer may be reduced and new chains may be initiated using the chain transfer agent. In addition, the molecular weight distribution may be adjusted using the chain transfer agent.

The content of the chain transfer agent may be from about 0.5 parts by weight to about 1.0 part by weight, based on 100 parts by weight of one or more polymerizable monomers. For example, the content of the chain transfer agent may be from about 0.6 parts by weight to about 0.8 parts by weight. If the content of the chain transfer agent is less than about 0.5 parts by weight, the fusing temperature may be increased due to very high molecular weight. Alternatively, if the content of the chain transfer agent is greater than about 1.0 part by weight, durability may be reduced due to the very low molecular weight.

Examples of the chain transfer agent may include sulfur containing compounds such as dodecanthiol, thioglycolic acid, thioacetic acid and mercaptoethanol; phosphorous acid compounds such as phosphorous acid and sodium phosphite; hypophosphorous acid compounds such as hypophosporous acid and sodium hypophosphite; and alcohols such as methyl alcohol, ethyl alcohol, isopropyl alcohol and n-butyl alcohol, but are not limited thereto.

The primary latex particles may further include a charge control agent. The charge control agent used may include a negative charge type charge control agent or a positive charge type charge control agent. The negative charge type charge control agent may include an organic metal complex or a chelate compound such as an azo dye containing chromium or a mono azo metal complex; a salicylic acid compound containing metal such as chromium, iron and zinc; or an organic metal complex of an aromatic hydroxycarboxylic acid and an aromatic dicarboxylic acid. Moreover, any known charge control agent may be used without limitation. The positive charge type charge control agent may include a modified product such as nigrosine and a fatty acid metal salt thereof and an onium salt including but not limited to a quaternary ammonium salt such as tributylammonium 1-hydroxy-4-naphthosulfonate and tetrabutylammonium tetrafluoro borate, which may be used alone or in combination. Since the charge control agent stably supports the electrophotographic toner on a developing roller by electrostatic force, charging may be performed stably and quickly using the charge control agent.

The prepared primary latex particle may be mixed with a colorant dispersion and a releasing agent dispersion. The colorant dispersion may be prepared by homogeneously dispersing a composition including but not limited to colorants such as black, cyan, magenta and yellow; and an emulsifier using an ultrasonic homogenizer, micro fluidizer, or the like.

Carbon black or aniline black may be used as the colorant for a black toner, and for color toner, at least one of yellow, magenta and cyan colorants are further included.

A condensation nitrogen compound, an isoindolinone compound, an anthraquine compound, an azo metal complex or an allyl imide compound may be used as the yellow colorant. In particular, C.I. pigment yellow 12, 13, 14, 17, 62, 74, 83, 93, 94, 95, 109, 110, 111, 128, 129, 147, 168, 180, or the like can be used.

A condensation nitrogen compound, an anthraquine compound, a quinacridone compound, a base dye lake compound, a naphthol compound, a benzo imidazole compound, a thioindigo compound or a perylene compound may be used as the magenta colorant. In particular, C.I. pigment red 2, 3, 5, 6, 7, 23, 48:2, 48:3, 48:4, 57:1, 81:1, 122, 144, 146, 166, 169, 177, 184, 185, 202, 206, 220, 221, 254, or the like may be used.

A copper phthalocyanine compound and derivatives thereof, an anthraquine compound, or a base dye lake compound can be used as the cyan colorant. In particular, C.I. pigment blue 1, 7, 15, 15:1, 15:2, 15:3, 15:4, 60, 62, 66, or the like may be used.

Such colorants may be used alone or in a combination of at least two colorants, and are selected in consideration of color, chromacity, luminance, resistance to weather, dispersion capability in toner, etc.

As described above, the content of the colorant should be sufficient to color the electrophotographic toner. The content of the colorant may be from about 3 parts by weight to about 10 parts by weight based on 100 parts by weight of the polymerizable monomer. For example, the content of the colorant may be from about 4 parts by weight to about 9 parts by weight. If the content of the colorant is less than about 3 parts by weight based on 100 parts by weight of the polymerizable monomer, a sufficient coloring effect may not be obtained. Alternatively, if the content of the colorant is greater than 10 parts by weight, manufacturing costs of the electrophotographic toner may be increased, and a sufficient friction charge may not be obtained.

Any emulsifier that is known in the art may be used in the colorant dispersion. In this regard, an anionic reactive emulsifier, a nonionic reactive emulsifier or a mixture thereof may be used. For example, the anionic reactive emulsifier may include HS-10 (Dai-ichi kogyo, Co., Ltd.), Dawfax 2A1 (Rhodia Inc.), etc., and the nonionic reactive emulsifier may include RN-10 (Dai-ichi kogyo, Co., Ltd.).

The releasing agent dispersion used in the method of preparing the electrophotographic toner may include a releasing agent, water, and an emulsifier.

Since the releasing agent may provide toner fused to a final image receptor at a low fusing temperature and having superior final image durability and an antiabrasion property, the type and content of the releasing agent plays an important role in the determination of toner characteristics.

Examples of the releasing agent that may be used may include polyethylene-based wax, polypropylene-based wax, silicon wax, paraffin-based wax, ester-based wax, carnauba wax and metallocene wax, but are not limited thereto. The melting point of the releasing agent may be from about 50° C. to about 150° C. Releasing agent components physically adhere to the toner particles, but do not covalently bond with the toner particles. Thus, the releasing agent may provide the electrophotographic toner fused to the final image receptor at a low fusing temperature and having superior final image durability and an antiabrasion property.

The content of the releasing agent may from about 5 parts by weight to about 10 parts by weight based on 100 parts by weight of the polymerizable monomer. For example, the content of the releasing agent may from about. 7 parts by weight to about 10 parts by weight. If the content of the releasing agent is less than about 5 parts by weight, low-temperature fusibility may be reduced, and the fusing temperature range may become narrower. Alternatively, if the content of the releasing agent is greater than about 10 parts by weight, the storability and economical efficiency may be reduced.

A wax containing an ester group may be used as the releasing agent. An example of the wax may include a mixture of an ester-based wax and a non-ester-based wax; or an ester group containing wax containing an ester group in a non-ester-based wax. The ester group has high affinity to the latex components of the electrophotographic toner. Thus, the wax may he uniformly distributed throughout the toner particles to effectively enhance the wax effects. In addition, the non-ester-based wax components may inhibit excessive plasticization. As a result, good development of the electrophotographic toner may be maintained for a long time.

Examples of the ester-based wax may include esters of fatty acids having 15-30 carbons, such as behenic acid behenyl ester, stearic acid stearyl ester, stearic acid of pentaerythritol, montanic acid glyceride ester, mono- through penta-alcohol, and the like. The alcohol component constituting the ester may have from 10 to 20 carbon atoms in case of the mono-alcohol. The alcohol component may have from 3 to 10 carbon atoms in case of the polyhydric alcohol.

The non-ester-based wax may include a polyethylene-based wax and a paraffin-based wax.

An example of the wax including the ester group may include but is not limited to a mixture of a paraffin-based wax and an ester-based wax; or an ester group containing paraffin-based wax. Particularly, model names P-280, P-318, and P-319 (products of Chukyo yushi Co., Ltd) may be used as the wax.

The content of the ester group of the releasing agent may be from about 2% by weight to about 10% by weight based on the total weight of the releasing agent. For example, the content of the ester group may be from about 5% by weight to about 7% by weight. If the content of the ester group is less than about 2% by weight, miscibility with the latex may be reduced. Alternatively, if the content of the ester group is greater than about 10% by weight, plasticization of the electrophotographic toner may be excessive, which may make it difficult to maintain the development of the electrophotographic toner for a long time.

Similar to the emulsifier used in the colorant dispersion, any emulsifier known in the art may be used as the emulsifier in the releasing agent dispersion. In this regard, an anionic reactive emulsifier, a nonionic reactive emulsifier or a mixture thereof may be used. For example, the anionic reactive emulsifier may include HS-10 (Dai-ichi kogyo, Co., Ltd.), Dawfax 2A1 (Rhodia Inc.), etc., and the nonionic reactive emulsifier may include RN-10 (Dai-ichi kogyo, Co., Ltd.).

The molecular weight $T_g$ and rheological properties of the primary latex particles formed in the core of toner prepared according to the methods described herein, may be adjusted to efficiently fuse toner particles at a low temperature.

To prepare the agglomerated toner, the prepared primary latex particles, the colorant dispersion, and the releasing agent dispersion are mixed, and an agglomerating agent may be added. More particularly, when the primary latex particles, the colorant dispersion, and the releasing agent dispersion are mixed, the agglomerating agent may be added to the mixture at a pH of about 1 to a pH of about 4 to form a primary agglomerated toner having an average particle size of less than about 2.5 μm as a core. Then, a secondary latex may be added and the pH of the mixture may be adjusted to a pH of about 6 to a pH of about 8. When the particle size is constantly maintained for a certain period of time, the resultant mixture may be heated to a temperature from about 90° C. to about 96° C., and the pH may be adjusted to about pH 6 to about pH 5.8 to prepare a secondary agglomerated toner.

One or more metallic salts selected from Si and Fe containing metallic salts may be used as the agglomerating agent. The Si and Fe containing metallic salts may include polysilica iron.

The second latex may be prepared by polymerizing one or more polymerizable monomers. The polymerizable monomers are emulsion polymerized to prepare a latex having a particle size of less than about 1 μm. For example, the latex may have a particle size in a range of about 100 nm to about 300 nm. The second latex may also include a wax, and the wax may be added to the second latex in the polymerization process.

A tertiary latex prepared by polymerizing one or more polymerizable monomers may be coated on the secondary agglomerated toner, thus preparing the electrographic toner.

By forming a shell layer with the secondary latex or the tertiary latex, durability may be improved, and the storability limitations of toner during shipping and handling may be overcome. Here, a polymerization inhibitor may be added in order to prevent new latex particles from being formed, or the reaction may be performed using a starved-feeding process to facilitate coating of the monomer mixture on the electrophotographic toner.

The prepared secondary agglomerated toner or tertiary agglomerated toner may be filtered to separate toner particles, and the toner particles dried. The dried toner particles are subjected to an external additive addition process using an external additive, and the charge amount may be controlled to prepare a final dry toner.

Silica. $TiO_2$, etc., may be used as the external additive. The content Of the external additive may be from about 1.5 parts by weight to about 4 parts by weight based on 100 parts by weight of non-additive toner. For example, the content of the external additive may be from about 2 parts by weight to about 3 parts by weight. If the content of the external additive may be less than about 1.5 parts by weight, a caking phenomenon in which toner adheres to each other due to a cohesive power there between may occur, and charging may not be uniformly performed. Alternatively, if the content of the external additive is greater than about 4 parts by weight, a roller may be contaminated by a large amount of the external additive.

The present disclosure provides a method of forming images including attaching the electrophotographic toner to a surface of a photoreceptor on which an electrostatic latent image may be formed to provide a visualized image; and transferring the visualized image to a transfer medium. The electrophotographic toner includes a latex, a colorant, and a releasing agent. The electrophotographic toner has a weight-average molecular weight of about 50,000 to about 80,000; a complex viscosity of about $1\times10^3$ to about $5\times10^4$ (Pa·s) at a temperature ranging from about 100° C. to about 140° C.; and dG'/dG" of about 1.10 to about 1.25.

A representative electrophotographic image forming process includes a series of processes of forming images on a receptor including but not limited to charging, exposure to light, developing, transferring, fusing, cleaning, and erasing.

In the charging process, a surface of a photoreceptor may be charged with negative or positive charges, as desired, by a corona or a charge roller. In the light exposing process, an optical system, conventionally a laser scanner or an array of diodes, selectively discharges the charged surface of the photoreceptor in an image-wise manner corresponding to the final visual image formed on the final image receptor to form the latent image. The optical system uses electromagnetic radiation, also referred to as "light", which may be infrared light irradiation, visible light irradiation, or ultra-violet light irradiation.

In the developing process, suitably charged toner particles generally contact the latent image of the photoreceptor, and conventionally, an electrically-biased developer having identical potential polarity to the toner polarity may be used. The toner particles move to the photoreceptor and are selectively attached to the latent image by electrostatic force to form a toner image on the photoreceptor.

In the transferring process, the toner image may be transferred to the final image receptor from the photoreceptor, and sometimes, an intermediate transferring element may be used to facilitate transferring the toner image from the photoreceptor to the final image receptor.

In the fusing process, the toner image of the final image receptor may be heated and the toner particles thereof are softened or melted, thereby fusing the toner image to the final image receptor. Another way of fusing is to fuse toner on the final image receptor under high pressure with or without the application of heat.

In the cleaning process, any residual toner remaining on the photoreceptor may be removed.

Finally, in the erasing process, charges of the photoreceptor are exposed to light of a predetermined wavelength band and are reduced to be substantially uniform and of low value and thus, the residue of the latent image may be removed and the photoreceptor may be prepared for the next image forming cycle.

A toner supplying unit according to an embodiment of the present disclosure includes: a toner tank for storing toner; a supplying part projecting inside the toner tank to discharge the toner from the toner tank; and a toner agitating member rotatably disposed inside the toner tank to agitate the toner in the toner tank including a location on a top surface of the supplying part. The electrophotographic toner includes a latex, a colorant, and a releasing agent. The toner has a weight-average molecular weight of about 50,000 to about 80,000; a complex viscosity of about $1\times10^3$ to about $5\times10^4$ (Pa·s) at a temperature ranging from about 100° C. to about 140° C.; and dG'/dG" of about 1.10 to about 1.25.

FIG. 1 is a view of a toner supplying apparatus 100 according to an embodiment of the present disclosure. In FIG. 1, the toner supplying apparatus 100 includes a toner tank 101, a supplying part 103, a toner-conveying member 105, and a toner-agitating member 110. The toner tank 101 stores a predetermined amount of toner and may be formed in a substantially hollow cylindrical shape. The supplying part 103 is disposed at the bottom of the inside of the toner tank 101 and discharges the stored toner from the inside of the toner tank 101 to an outside of the toner tank 101. For example, the supplying part 103 may project from the bottom of the toner tank 101 to the inside of the toner tank 101 in a pillar shape with a semi-circular section. The supplying part 103 includes a toner outlet (not shown) to discharge the toner to an outer surface thereof.

The toner-conveying member 105 may be disposed at a side of the supplying part 103 at the bottom of the inside of the toner tank 101. The toner-conveying member 105 may be formed in, for example, a coil spring shape. An end of the toner-conveying member 105 extends in an inside the supplying part 103 so that when the toner-conveying member 105 rotates, the toner in the toner tank 101 may be conveyed to the inside of the supplying part 103. The toner conveyed by the toner-conveying member 105 may be discharged to the outside through the toner outlet.

The toner-agitating member 110 may be rotatably disposed inside the toner tank 101 and forces the toner in the toner tank 101 to move in a radial direction. For example, when the toner-agitating member 110 rotates at a middle of the toner tank 101, the toner in the toner tank 101 may be agitated to prevent the toner from solidifying. As a result, the toner moves down to the bottom of the toner tank 101 by its own weight. The toner-agitating member 110 includes a rotation shaft 112 and a toner agitating film 120. The rotation shaft 112 may be rotatably disposed at the middle of the toner tank 101 and has a driving gear (not shown) coaxially coupled with an end of the rotation shaft 112 projecting from a side of the toner tank 101. thus, the rotation of the driving gear causes the rotation shaft 112 to rotate. The rotation shaft 112 may have a wing plate 114 to help fix the toner agitating film 120 to the rotation shaft 112. The wing plate 114 may be formed to be substantially symmetric about the rotation shaft 112. The toner agitating film 120 has a width corresponding to the inner length of the toner tank 101. The toner agitating film 120 may be elastically deformable. For example, the toner agitating film 120 may bend toward or away from a projection inside the toner tank 101, i.e., the supplying part 103. Portions of the toner agitating film 120 may be cut off from the toner agitating film 120 toward the rotation shaft 112 to form a first agitating part 121 and a second agitating part 122.

An imaging apparatus according to an embodiment of the present disclosure includes: an image carrier; an image forming unit that forms an electrostatic latent image on a surface' of the image carrier; a unit receiving a toner, a toner supplying unit that supplies the toner onto the surface of the image carrier to develop the electrostatic latent image on the surface of the image carrier into a toner image; and a toner transferring unit that transfers the toner image to a transfer medium from the surface of the image carrier. The electrophotographic toner includes a latex, a colorant, and a releasing agent. The electrophotographic toner has a weight-average molecular weight of about 50,000 to about 80,000; a complex viscosity of about $1\times10^3$ to about $5\times10^4$ (Pa·s) at a temperature ranging from about 100° C. to about 140° C.; and dG'/dG" of about 1.10 to about 1.25.

Figure 2:
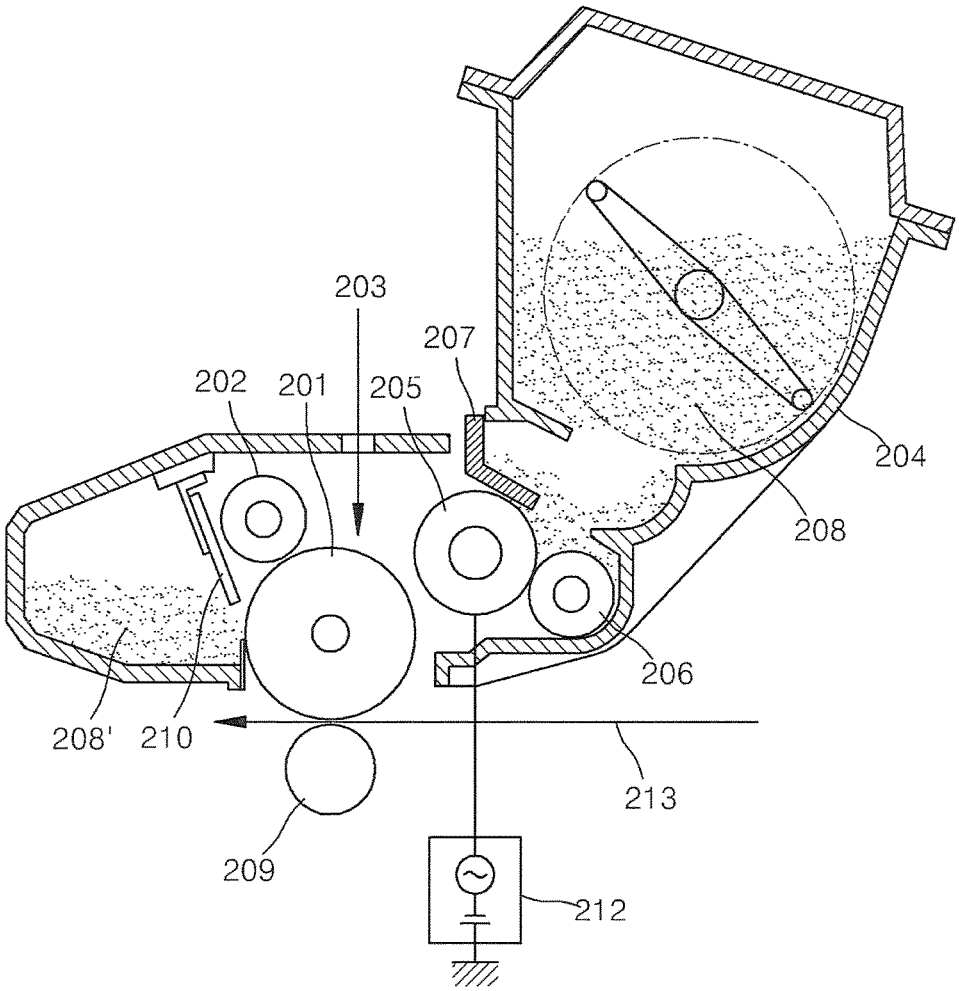
FIG. 2 is a view of an image forming apparatus including toner prepared according to an embodiment of the present disclosure.

FIG. 2 is a view of a non-contact development type imaging apparatus including toner prepared using a method according to an embodiment of the present disclosure. In FIG. 2, the developer (for example, toner) 208, which includes a nonmagnetic one-component of a developing device 204, may be supplied to a developing roller 205 by a supply roller 206 formed of an elastic material such as polyurethane foam or sponge. The developer 208 supplied to the developing roller 205 reaches a contact portion between the developer controlling blade 207 and the developing roller 205 due to rotation of the developing roller 205. The developer controlling blade 207 may be formed of an elastic material, such as metal or rubber. When the developer 208 passes through the contact portion between the developer controlling blade 207 and the developing roller 205, the developer 208 may be controlled and formed into a thin layer that has a uniform thickness and may be sufficiently charged. The developer 208, which has been formed into a thin layer, may be transferred to a. development region of a photoreceptor 201 that is an image carrier, in which a latent image may be developed by the developing roller 205. The latent image may then be formed by scanning light 203 to the photoreceptor 201.

The developing roller 205 may be separated from the photoreceptor 201 by a predetermined distance and faces the photoreceptor 201. The developing roller 205 rotates in a counter-clockwise direction, and the photoreceptor 201 rotates n clockwise direction.

The developer 208, which has been transferred to the development region of the photoreceptor 201, develops the latent image formed on the photoreceptor 201 by an electric force generated by a potential difference between a direct current (DC) biased alternating current (AC) voltage applied to the developing roller 205 and the latent potential of the photoreceptor 201 charged by a charging unit 202 so as to form a toner image.

The developer 208, which has been transferred to the photoreceptor 201, reaches a transfer unit 209 due to the rotation direction of the photoreceptor 201. The developer 208 may be transferred to a print medium 213 to form an image by the transfer unit 209 having a roller shape and to which a high voltage having a polarity opposite to the developer 208 may be applied; or by corona discharging when the print medium 213 passes between the photoreceptor 201 and the transfer unit 209.

The image transferred to the print medium 213 passes through a high temperature and high pressure fusing device (not shown) and thus, the developer 208 may be fused to the print medium 213 to form the image. Meanwhile, a non-developed, residual developer 208' on the developing roller 205 may be collected by the supply roller 206 to contact the developing roller 205, and the non-developed, residual developer 208' on the photoreceptor 201 may be collected by a cleaning blade 210. The processes described above are then repeated.

Various embodiments of the present disclosure will be described in further detail with reference to the following examples. However, the present disclosure is not limited thereto.

EXAMPLES

Example 1

Synthesis of Primary Latex Particle

A monomer mixture (970 g of styrene, 192 g of n-butyl acrylate, 36 g of 2-carboxyethylacrylate, and 4.2 g of A-decadiol diacrylate as a cross-linking agent) and 18.8 g of 1-dodecanethiol (Aldrich) as a chain transfer agent (CTA) (about 0.7 parts by weight based on 100 parts by weight of a monomer) are added to a 3 L beaker, 500 g of a sodium dodecylsulfate (Aldrich) aqueous solution (2% in water) as an emulsifier is added, and the mixture is agitated to prepare a monomer emulsion. The prepared monomer emulsion is added to a 3 L double jacketed reactor and heated to a temperature of about 75° C. 18 g of potassium persulfate (KPS) as an initiator and 1,160 g of a sodium dodecylsulfate (Aldrich) aqueous solution (0.13% in water) as an emulsifier are slowly added dropwise over 2 hours to provide a an emulsion. The mixture is reacted at the reaction temperature for 8 hours. When the reaction is terminated, a monomer mixture (145 g of styrene, 66 g of n-butyl acrylate, and 9 g of methacrylic acid) and 3.3 g of 1-dodecanethiol (Aldrich) is added over 60 minutes to the reactor using a starved feed process and the mixture is further reacted for 6 hours. The resultant mixture is allowed to cool to obtain primary latex particles. The size of each of the obtained primary latex particles is measured by a light scattering (Horiba 910), wherein the average size thereof is about 170 nm.

Preparation of Colorant Dispersion 10 g of a mixture of an anionic reactive emulsifier (HS-10; DAI-ICH KOGYO) and 60 g of a cyan colorant are added to a milling bath. 400 g of glass beads each having a diameter of about 0.8 mm to about 1 mm are added to mill the mixture at room temperature, and the mixture is dispersed using an ultrasonic homogenizer, for example, Sonic and materials VCX750, to provide a dispersion.

Cohesion and Preparation of Toner 500 g of deionized water, 150 g of the primary latex particles for a core, 35 g of the cyan colorant dispersion (HS-10 100%), and 28 g of a wax dispersion P-280 (Chukyo yushi Co., Ltd) are added to a 1 L reactor to prepare a mixture. 15 g of nitric acid (0.3 mol) and 136.4g of 16% PSI-025 (sold by Suido KiKo Co.) as an agglomerating agent are added to the mixture, and the resultant mixture is agitated at 11,000 rpm for 6 minutes using a homogenizer, thereby to obtain a primary agglomerated toner having a volume average diameter of about 1.5 pm to about 2.5 inn. The resultant mixture is added to a 1 L double jacketed reactor, and heated from room temperature to about 50° C. (greater than $T_g$−5° C. of the latex) at a rate of 0.05° C. per minute. When the volume average diameter of the primary agglomerated toner reaches about 5.8 μm, 50 g of a secondary latex prepared by polymerizing polystyrene-based polymerizable monomers, is added thereto. When the volume average diameter is about 6.0 μm, NaOH (1 mol) is added thereto in order to adjust the pH to 8. When the value of the volume average diameter is constantly maintained for 10 minutes, the temperature is increased to 96° C. (at a rate of 0.5° C./min). When the temperature reaches 96° C., nitric acid (0.3 mol) is added thereto to adjust the pH to 6.6. The resultant mixture is agglomerated for 4 hours to obtain a secondary agglomerated toner having a volume average diameter of about 5 μm to about 6 μm in a potato-shape form. The secondary agglomerated toner is cooled to a temperature lower than $T_g$, and the toner particles are separated through a separation process, and dried.

The dried toner particles are subjected to an external adding process by adding 0.5 parts by weight of NX-90 (Nippon Aerosil), 1.0 parts by weight of RX-200 (Nippon Aerosil), and 0.5 parts by weight of SW-100 (Titan Kogyo) to 100 parts by weight of the dried toner particles, and agitating the mixture in a mixer (KM-LS2K, Dae Wha Tech) at 8,000 rpm for 4 minutes. Toner having a volume average diameter of about 5.9 μm is obtained. GSDp and GSDv of the toner are 1.25 and 1.2, respectively. Also, the average circularity of the toner is 0.97.

Example 2

Preparation of Toner

Toner is prepared in a same mariner as in Example 1, except 0.7 parts by weight of 1-dodecanethiol as a CTA, based on 100 parts by weight of a monomer, is added, and 860 g of 1.7% KPS is added and the mixture is allowed to react under nitrogen purging for 70 minutes. The GSDp and GSDv of the toner are 1.23 and 1.21, respectively, and the average circularity of the toner is 0.95.

Example 3

Preparation of Toner

Toner is prepared in a same manner as in Example 1, except 0.7 parts by weight of 1-dodecanethiol as a CTA, based on 100 parts by weight of a monomer, is added, and 860g of 1.5% KPS is added and the mixture is allowed to react under nitrogen purging for 120 minutes. The GSDp and GSDv of the toner are 1.23 and 1.21, respectively, and the average circularity of the toner is 0.97.

Example 4

Preparation of Toner

Toner is prepared in a same manner as in Example 1, except 0.7 parts by weight of 1-dodecanethiol as a CTA, based on 100 parts by weight of a monomer, is added, and 860g of 1.5% KPS is added and the mixture is allowed to react under nitrogen purging for 150 minutes. The GSDp and GSDv of the toner are 1.21 and 1.20, respectively, and the average circularity of the toner is 0.96.

Comparative Example 1

Toner is prepared in a same manner as in Example 1, except 0.7 parts by weight of 1-dodecanethiol as a CTA, based on 100 parts by weight of a monomer, are added, and 860 g of 1.5% KPS is added and the mixture is allowed to react under nitrogen purging for 90 minutes. The GSDp and GSDv of the toner are 1.25 and 1.22, respectively, and the average circularity of the toner is 0.94.

Comparative Example 2

Toner is prepared in a same manner as in Example 1, except 0.7 parts by weight of 1-dodecanethiol as a CTA, based on 100 parts by weight of a monomer are added, and 860 g of 2.5% KPS is added and the mixture is allowed to react under nitrogen purging for 60 minutes. The GSDp and GSDv of the toner are 1.25 and 1.23, respectively, and the average circularity of the toner is 0.96.

Comparative Example 3

Toner is prepared in a same manner as in Example 1, except 0.7 parts by weight of 1-dodecanethiol as a CTA, based on 100 parts by weight of a monomer are added, and 860 g of 2.3% KPS is added and the mixture is allowed to react under nitrogen purging for 30 minutes. The GSDp and GSDv of the toner are 1.23 and 1.20, respectively, and the average circularity of the toner is 0.97.

Comparative Example 4

Toner is prepared in a same manner as in Example 1, except 0.7 parts by weight of 1-dodecanethiol as a CTA, based on 100 parts by weight of a monomer, are added, and 860 g of 2.5% KPS is added and the mixture is allowed to react under nitrogen purging for 30 minutes. The GSDp and GSDv of the toner are 1.26 and 1.22, respectively, and the average circularity of the toner is 0.94.

Comparative Example 5

Toner is prepared in a same manner as in Example 1, except 0.7 parts by weight of 1-dodecanethiol as a CTA, based on 100 parts by weight of a monomer, are added, and 860 g of 2.1% KPS is added and the mixture is allowed to react under nitrogen purging for 120 minutes. The GSDp and GSDv of the toner are 1.27 and 1.25, respectively, and the average circularity of the toner is 0.94.

Example 5

Method of Evaluating Toner

Weight-Average Molecular Weight Measurement

A weight-average molecular weight Mw may be measured using a gel permeation chromatogram (GPC) (Waters 2421).

Complex Viscosity Measurement

A room temperature compressed specimen having a diameter of about 8 mm may be measured using TA ARES. The specimen may be measured under the condition that a gap between plates of the TA ARES may be set to within about 2 mm, a temperature rises by about 2° C./minute at a temperature of about 40° C., and a frequency may be fixed to about 6.28 rad/s. Strain may be set after a linear section of a sample is confirmed.

Measurement of the dG'/dG" Ratio

A room temperature compressed specimen having a diameter of about 25 mm may be measured using TA ARES. A gap between plates of the TA ARES may be set to within about 2 mm, and a temperature may be measured at a temperature higher than a glass transition temperature $T_g$ or a melting point $T_m$. The specimen may be measured at a frequency of about 0.1 rad/s to about 100 rad/s at three different temperatures (for example, about 100° C., about 120° C., and about 140° C.). Strain may be set after a linear section of a sample is confirmed.

Fusing Property Evaluation

Equipment: Belt-type fusing device (Fusing devide—manufacturer: SAMSUNG ELECTRONICS CO. LTD., Product name: color laser 660 model)

Non-fused image for test: 100% pattern test temperature: 100~200° C. (10° C. intervals)

fusing speed: 160 mm/sec fusing time: 0.08 sec

After a test is performed under the above-stated conditions, fusibility of the fused image is evaluated according to following criteria.

After an outer diameter (OD) of the fused image may be measured, a 3M 810 tape may be attached to an image portion, and then a 500 g weight may be reciprocated five times to remove the tape. After the tape is removed, the OD may be measured.

Fusibility (%)=(after peeling off the OD_tape/before peeling off the OD_tape)×100.

A fusing temperature region having fusibility of greater than about 90% may be regarded as a fusing region of toner.

MFT: Minimum Fusing Temperature [a minimum temperature having fusibility of greater than about 90% without causing Cold-offset].

HOT: Hot Offset Temperature [a minimum temperature at which Hot-offset occurs]

Glossiness Evaluation

Glossiness is measured at a temperature of about 160° C., which is an operational temperature of the fusing device using a glossmeter (manufacturer: BYK Gardner, Product name: micro-TRI-gloss) that is a device for measuring glossiness.

Measurement angle: about 60°

Measurement pattern: 100% pattern

High-Temperature Conservation Evaluation

After 100 g of the toner is externally added, the externally added toner is introduced into a developing device (manufacturer: SAMSUNG ELECTRONICS CO. LTD., Product name: color laser 660 model) to store the toner in a constant-temperature and constant-humidity oven in a packaged state under the following conditions.

23° C., RH (Relative Humidity) of 55% for 2 hours

=>40° C., RH of 90% for 48 hours

=>50° C., RH of 80% for 48 hours

=>40° C., RH of 90% for 48 hours

=>23° C., RH of 55% for 6 hours

After the toner is stored under the above-stated conditions, it may be determined whether a caking phenomenon occurs at the toner within the developing device with the naked eye and an image may be completely outputted to evaluate image defect.

Reference of evaluation

◎ Good image, No-caking, Cohesion less than 10

○: Good image, No-caking, Cohesion of from 10 to 20

Δ: Poor image, No-caking x: Caking occurrence

Agglomeration evaluation (Carr's Cohesion)

Equipment: Hosokawa micron powder tester PT-S

Sample volume: 2 g (external additive toner or non-additive toner)

Amplitude: 1 mm_dial 3~3.5

Sieve: 53, 45, 38 μm

Vibration time: 120 seconds

After the sample is stored at a temperature of about 23° C. and RH of 55% for 2 hours, the sieve for each size may be measured before and after the changes under the above-stated conditions to calculate cohesion of toner using the following equation:

[(a mass of powder remaining on the sieve having the largest size)/2 g]×100 (1)

[(a mass of powder remaining on the sieve having a middle size)/2 g]×100 (2)

[(a mass of powder remaining on the sieve having the smallest size)/2 g]×100×(⅕) (3)

Carr's Cohesion=(1)+(2)+(3)

Evaluation reference

◎: Agglomeration less than 10

○: Agglomeration of 10 to 20

Δ: Agglomeration of 20 to 40 x: Agglomeration greater than 10

Durability Evaluation

Durability may be determined according to whether an image streak and a developing roller image occur after 500 sheets of paper are discharged without printing under the driving condition of about 20 PPM using a color laser printer (manufacturer: SAMSUNG ELECTRONICS CO. LTD., Product name: color laser 660 model). As a result, the symbol ○ denotes a state in which contamination does not occur, the symbol □ denotes a state in which contamination occurs, but images are not affected by the contamination, and the symbol x denotes a state in which images are affected by contamination. The results are shown Table 2.

In case of Comparative Example 2, since the dG'/dG" ratio of the toner may be relatively high. It may be assumed that the dispersion state and the molecular weight distribution of the toner are superior. However, it can be seen that the high-temperature conservation and the durability of the toner are inferior due to low molecular weight. Also, since the viscosity may be low at a temperature of 140° C., it may be difficult to adjust a proper temperature section according to a fusing speed.

In case of Comparative Examples 3 and 4, since the dG'/dG" ratio of the toner may be relatively low, it may be assumed that the molecular weight distribution and dispersion state are inferior. As a result, it can be seen that the high-temperature conservation and the durability of the toner are inferior because a wax exists on a surface of the toner.

In case of Comparative Example 5, since the dG'/dG" ratio of the toner may be relatively proper, it may be assumed that the dispersion state may be superior. However, it can be seen that the high-temperature conservation and the durability of the toner are inferior due to low molecular weight.

While the present disclosure has been particularly shown and described with reference to the embodiments thereof, it will be understood by those of ordinary skill in the art that various changes in form and details may be made therein without departing from the spirit and scope of the present disclosure as defined by the following claims.

TABLE 2

| | Weight-Average | | | | Fusing Property | | | | | High-temp |
|---|---|---|---|---|---|---|---|---|---|---|
| | Mol Weight (Mw) | dG'/dG" | Glossiness | Complex Viscosity | 160 mm/s MFT | 80 mm/s HOT | Temperature Difference | Fluidity | Durability | Conservation |
| Example 1 | 68,000 | 1.22 | 7.1 | $1.5 \times 10^3$~$4.5 \times 10^4$ | 150° C. | 210° C. | 60 | ◎ | ◎ | ◎ |
| Example 2 | 72,000 | 1.12 | 6.3 | $1.7 \times 10^3$~$4.8 \times 10^4$ | 150° C. | 200° C. | 50 | ◎ | ○ | ◎ |
| Example 3 | 51,000 | 1.17 | 8.8 | $1.0 \times 10^3$~$3.5 \times 10^4$ | 130° C. | 190° C. | 60 | ◎ | ○ | ○ |
| Example 4 | 77,000 | 1.23 | 6.0 | $2.0 \times 10^3$~$5.0 \times 10^4$ | 140° C. | 220° C. | 60 | ○ | ◎ | ◎ |
| Comparative example 1 | 83,000 | 1.19 | 3.7 | $3.5 \times 10^3$~$6.0 \times 10^4$ | 170° C. | 210° C. | 40 | Δ | ○ | ◎ |
| Comparative example 2 | 35,000 | 1.13 | 6.7 | $2.0 \times 10^2$~$2.7 \times 10^4$ | 130° C. | 170° C. | 40 | Δ | Δ | Δ |
| Comparative example 3 | 75,000 | 1.05 | 4.3 | $2.3 \times 10^3$~$5.0 \times 10^4$ | 140° C. | 190° C. | 50 | Δ | Δ | Δ |
| Comparative example 4 | 65,000 | 0.98 | 4.7 | $1.5 \times 10^3$~$5.0 \times 10^4$ | 140° C. | 190° C. | 50 | ○ | Δ | Δ |
| Comparative example 5 | 47,000 | 1.23 | 10.5 | $7.0 \times 10^2$~$3.3 \times 10^4$ | 140° C. | 180° C. | 40 | ○ | Δ | ○ |

Referring to Table 2, in Examples 1 through 5, a toner having the molecular weight of 50,000 to 80,000 is provided. The dG'/dG" ratio of the toner is from about 1.10 to about 1.25, and the MFT is less than about 150° C. at 160 mm/s, and the glossiness is greater than about 5.0. It can be seen that the toner has superior fluidity, durability, and high-temperature conservation.

In case of Comparative Example 1, since the molecular weight of the toner may be very high, the MFT<160° C. may be not satisfied. In addition, the dG'/dG" ratio of the toner may be lower than that of a sample having a relatively similar molecular weight distribution. As a result, the fluidity of the toner may be reduced. Also, it can be seen that the MFT of the toner may be significantly greater than that of other toners due to a very high viscosity.

What is claimed is:

1. An electrophotographic toner comprising a latex, a colorant, and a releasing agent, wherein the electrophotographic toner has a weight-average molecular weight of about 50,000 to about 80,000; a complex viscosity of about $1\times10^3$ to about $5\times10^4$ (Pa·s) at a temperature ranging from about 100° C. to about 140° C.; and a dG'/dG" ratio of about 1.10 to about 1.25 at temperatures from about 100° C. to less than 140° C., the dG'/dG" ratio being defined as ΔG'/ΔG", where ΔG' is a first change in G' and ΔG" is a second change in G" over a frequency region of about 0.1 rad/s to about 100 rad/s.

2. The electrophotographic toner of claim 1, further comprising silicon (Si) and iron (Fe), each independently in a range of about 3 ppm to about 1,000 ppm.

3. The electrophotographic toner of claim 1, wherein the releasing agent comprises a mixture of a paraffin-based wax and an ester-based wax; or an ester group containing paraffin-based wax.

4. The electrophotographic toner of claim 3, wherein the releasing agent has a content of an ester group from about 2% by weight to about 10% by weight based on the total weight of the releasing agent.

5. The electrophotographic toner of claim 1, wherein the toner has a volume average particle diameter of about 3 μm to about 8 μm.

6. The electrophotographic toner of claim 1, wherein the toner has an average value of circularity of about 0.940 to about 0.980.

7. The electrophotographic toner of claim 1, wherein the toner has a value of a volume average particle size distribution index (GSDv) and a number average particle size distribution index (GSDp) less than about 1.25, respectively.

8. A method of preparing an electrophotographic toner, the method comprising the steps of:

a) mixing a primary latex particle, a colorant dispersion, and a releasing agent dispersion to prepare a mixture;

b) adding an agglomerating agent to the mixture to prepare a primary agglomerated toner; and c) coating a secondary latex, prepared by polymerizing one or more polymerizable monomers, on the primary agglomerated toner to provide a secondary agglomerated toner, thus preparing the electrophotographic toner, wherein the electrophotographic toner has a weight-average molecular weight of about 50,000 to about 80,000; a complex viscosity of about $1\times10^3$ to about $5\times10^4$ (Pa·s) at a temperature ranging from about 100° C. to about 140° C.; and a dG'/dG" ratio of about 1.10 to about 1.25 at temperatures from about 100° C. to less than 140° C., the dG'/dG" ratio being defined as ΔG'/ΔG", where ΔG' is a first change in G' and AG" is a second change in G" over a frequency region of about 0.1 rad/s to about 100 rad/s.

9. The method of claim 8, wherein the primary latex particle comprises polyester alone; a polymer obtained by polymerizing one or more polymerizable monomers; or a mixture thereof.

10. The method of claim 8, the method further comprising the step of:

d) coating a tertiary latex, prepared by polymerizing one or more polymerizable monomers, on the secondary agglomerated toner, to provide a tertiary agglomerated toner, thus preparing the electro graphic toner.

11. The method of claim 8, wherein the polymerizable monomer comprises at least one monomer selected from styrene-based monomers; acrylic acid or methacrylic acid; derivatives of (metha)acrylates; ethylenically unsaturated mono-oletins; halogenized vinyls; vinyl esters; vinyl ethers; vinyl ketones; and nitrogen containing vinyl compounds.

12. The method of claim 8, wherein the releasing agent dispersion comprises a mixture of a paraffin-based wax and an ester-based wax; or an ester group containing paraffin-based wax.

13. The method of claim 8, wherein the agglomerating agent comprises Si and Fe containing metallic salts.

14. The method of claim 8, wherein the agglomerating agent comprises polysilica iron.

* * * * *